US006883417B2

(12) United States Patent
Headley et al.

(10) Patent No.: US 6,883,417 B2
(45) Date of Patent: Apr. 26, 2005

(54) CONNECTING CONFIGURATION FOR A DIAPHRAGM IN A DIAPHRAGM PUMP

(75) Inventors: Thomas R. Headley, Bryan, OH (US); Lloyd I. Towne, Bryan, OH (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 10/391,711

(22) Filed: Mar. 19, 2003

(65) Prior Publication Data

US 2004/0182237 A1 Sep. 23, 2004

(51) Int. Cl.[7] ..... F01B 19/02

(52) U.S. Cl. ..... 92/99

(58) Field of Search ..... 92/99, 100

(56) References Cited

U.S. PATENT DOCUMENTS

| | | | | |
|---|---|---|---|---|
| 2,381,544 | A | * | 8/1945 | Jacobsen ..... 251/267 |
| 2,952,218 | A | * | 9/1960 | Steffes ..... 92/99 |
| 3,070,029 | A | | 12/1962 | Russell |
| 3,385,174 | A | * | 5/1968 | Crosland ..... 92/100 |
| 3,604,822 | A | | 9/1971 | Saxe |
| 4,403,539 | A | * | 9/1983 | Motoki et al. ..... 92/99 |
| 4,448,063 | A | | 5/1984 | Mudge et al. |
| 4,740,202 | A | | 4/1988 | Stacey et al. |
| 4,795,448 | A | | 1/1989 | Stacey et al. |
| 4,830,586 | A | | 5/1989 | Herter et al. |
| 4,872,816 | A | | 10/1989 | Fetcko |
| 4,936,753 | A | | 6/1990 | Kozumplik, Jr. et al. |
| 4,978,283 | A | | 12/1990 | Vonalt |
| 5,108,270 | A | | 4/1992 | Kozumplik, Jr. |
| 5,129,427 | A | | 7/1992 | White et al. |
| 5,269,664 | A | | 12/1993 | Buse |
| D347,639 | S | | 6/1994 | Fast et al. |
| 5,334,003 | A | | 8/1994 | Gardner et al. |
| 5,345,965 | A | | 9/1994 | Blume |
| 5,366,351 | A | | 11/1994 | Nolte |
| 5,391,060 | A | | 2/1995 | Kozumplik, Jr. et al. |
| 5,450,987 | A | | 9/1995 | Nolte |
| D370,488 | S | | 6/1996 | Kozumplik, Jr. et al. |
| 5,551,847 | A | | 9/1996 | Gardner et al. |
| 5,559,310 | A | | 9/1996 | Hoover et al. |
| 5,584,666 | A | | 12/1996 | Kozumplik, Jr. et al. |
| 5,634,391 | A | | 6/1997 | Eady |
| 5,647,737 | A | | 7/1997 | Gardner et al. |
| 5,649,809 | A | | 7/1997 | Stapelfeldt |
| 5,649,813 | A | | 7/1997 | Able et al. |
| 5,664,940 | A | | 9/1997 | Du |
| 5,687,633 | A | | 11/1997 | Eady |
| D388,796 | S | | 1/1998 | Conti et al. |
| D388,797 | S | | 1/1998 | Conti et al. |
| 5,711,658 | A | | 1/1998 | Conti et al. |
| 5,733,253 | A | | 3/1998 | Headley et al. |
| 5,737,920 | A | | 4/1998 | Able |
| 5,848,615 | A | | 12/1998 | Conti et al. |
| 5,848,878 | A | | 12/1998 | Conti et al. |
| 5,885,239 | A | | 3/1999 | Headley et al. |

(Continued)

FOREIGN PATENT DOCUMENTS

| | | |
|---|---|---|
| CA | 2 285 586 | 4/2001 |
| EP | 0 125 467 | 11/1984 |
| GB | 983694 | 2/1965 |
| GB | 2 105 819 | 3/1983 |

*Primary Examiner*—F. Daniel Lopez
(74) *Attorney, Agent, or Firm*—Michael Best & Friedrich LLP

(57) ABSTRACT

A diaphragm pump including at least one diaphragm having an inner diaphragm surface, an outer diaphragm surface, and a projecting rim, the rim projecting from the inner diaphragm surface and having an inner circumferential surface and an outer circumferential surface, a hub positioned to lie within the inner circumferential surface of the projecting rim, a ring positioned around the outer circumferential surface of the projecting rim, where the hub and ring secure the projecting rim there between, and a reciprocating rod coupled to at least one of the hub and the ring.

38 Claims, 5 Drawing Sheets

U.S. PATENT DOCUMENTS

| | | | |
|---|---|---|---|
| 5,893,490 | A | 4/1999 | Gnyp |
| 5,894,784 | A | 4/1999 | Bobbitt, III et al. |
| 5,905,212 | A | 5/1999 | Moses et al. |
| 5,951,259 | A | 9/1999 | Gardner et al. |
| 5,951,267 | A | 9/1999 | Piercey et al. |
| 6,019,742 | A | 2/2000 | Headley et al. |
| 6,039,711 | A | 3/2000 | Headley et al. |
| 6,065,389 | A | 5/2000 | Riedlinger |
| 6,074,335 | A | 6/2000 | Headley et al. |
| 6,099,491 | A | 8/2000 | Headley et al. |
| 6,113,359 | A | 9/2000 | Watts et al. |
| 6,142,749 | A | 11/2000 | Jack et al. |
| 6,145,430 | A | 11/2000 | Able et al. |
| 6,168,387 | B1 | 1/2001 | Able et al. |
| 6,190,136 | B1 | 2/2001 | Meloche et al. |
| 6,230,609 | B1 | 5/2001 | Bender et al. |
| 6,257,845 | B1 | 7/2001 | Jack et al. |
| 6,280,149 | B1 | 8/2001 | Able et al. |
| 6,299,173 | B1 | 10/2001 | Lai |
| 6,299,413 | B1 | 10/2001 | Stahlman et al. |
| 6,363,894 | B1 | 4/2002 | Barkman |
| 6,558,141 | B1 | 5/2003 | Vonalt et al. |
| 6,602,179 | B1 | 8/2003 | Headley et al. |
| 6,644,941 | B1 | 11/2003 | Able et al. |
| D484,145 | S | 12/2003 | Roberts et al. |
| 6,722,256 | B1 | 4/2004 | Roberts et al. |
| 2001/0051569 | A1 | 12/2001 | Headley |
| 2003/0110939 | A1 | 3/2003 | Able et al. |
| 2003/0125182 | A1 | 7/2003 | Headley et al. |
| 2003/0198560 | A1 | 10/2003 | Able et al. |
| 2004/0018053 | A1 | 1/2004 | Starry, Jr. et al. |
| 2004/0047748 | A1 | 3/2004 | Roberts et al. |
| 2004/0047749 | A1 | 3/2004 | Roberts et al. |
| 2004/0050242 | A1 | 3/2004 | Roberts et al. |
| 2004/0069140 | A1 | 4/2004 | Able et al. |

* cited by examiner

CONNECTING CONFIGURATION FOR A DIAPHRAGM IN A DIAPHRAGM PUMP

BACKGROUND OF THE INVENTION

This invention relates generally to diaphragm pumps, and more particularly to air operated diaphragms of diaphragm pumps.

Diaphragm pumps are widely known in the art and are used in pumping a wide variety of fluids. Generally, the most critical driving element of the diaphragm pump is the diaphragm. The diaphragm is typically a circular membrane made of a flexible material, such as rubber or a thermoplastic elastomer. In the case of an air-operated diaphragm pump, the diaphragm separates an air chamber from a fluid chamber. Reciprocal movement of the diaphragm creates pressure variations within the fluid chamber that causes the fluid to pump through the fluid chamber. One type of diaphragm pump, a double-diaphragm pump, is also widely known in the art and provides a nearly constant flow of fluid from the pump by utilizing two reciprocating, interconnected diaphragms.

SUMMARY OF THE INVENTION

To impart reciprocal movement to the diaphragm, a connecting rod is often coupled to the diaphragm, which itself is driven in a reciprocating motion by an air valve assembly. Several conventional practices exist to couple the connecting rod with the diaphragm. One conventional practice includes forming the diaphragm with a centralized aperture and sandwiching the diaphragm between conventional fasteners, such as nuts and washers, secured to an end of the connecting rod. This practice results in creating a potential leak path between the air chamber and fluid chamber, which ideally is fluidly separated by the diaphragm. Also, loosening of the fasteners may affect the pump's performance, and may eventually lead to complete operational failure of the pump.

Another conventional practice for coupling the connecting rod to the diaphragm involves overmolding an insert to create the diaphragm. Generally, the insert includes a threaded stud protruding from the insert to engage threads formed in a recess of the connecting rod. Alternatively, the insert includes a threaded recess to engage a threaded end of the connecting rod. This practice effectively eliminates the possibility of a leak path between the air and fluid chambers of the pump through the diaphragm. However, additional manufacturing costs are incurred due to the sensitive process (i.e., heating, pouring, and curing of the diaphragm material, etc.) of overmolding the insert to create the diaphragm. If the process is not carefully controlled, delamination of the diaphragm often results, leading to operational failure of the pump.

The present invention provides a diaphragm pump including at least one diaphragm having an inner diaphragm surface, an outer diaphragm surface, and a projecting rim projecting from the inner diaphragm surface. The projecting rim includes an inner circumferential surface and an outer circumferential surface. A hub is positioned to lie within the inner circumferential surface of the projecting rim and a ring is positioned around the outer circumferential surface of the projecting rim. The hub and ring secure the projecting rim there between, and a reciprocating rod is coupled to at least one of the hub and the ring.

The present invention also provides a diaphragm pump including a diaphragm having a tapered projecting rim or bead of varied cross section projecting from an inner surface of the diaphragm, a tapered hub or encapsulating rim having a circumferential outer surface mating with the tapered projecting rim or bead, and a reciprocating rod coupled to the hub.

Further, the invention provides a diaphragm pump including a diaphragm having a projecting rim. The projecting rim defines a base portion coupled to the diaphragm and a distal portion having a larger thickness than the base portion. The diaphragm pump also includes a hub having a first end and a second end. The hub tapers from the first end to the second end. The first end is adjacent to the base portion of the rim and the second end is adjacent to the distal portion of the rim. A ring engages an outer circumferential surface of the projecting rim, such that the projecting rim is pinched between the hub and the ring. A reciprocating rod is coupled to the hub, such that the ring is secured to the hub between the rod and the hub.

The invention also provides a method of assembling a diaphragm pump. The method includes providing a diaphragm including a substantially orthogonal rim projecting from the diaphragm, the rim having an inner circumferential surface and an outer circumferential surface. The method also includes inserting a hub into the rim to engage the inner circumferential surface. Further, the method includes inserting a ring over the rim to engage the outer circumferential surface. Also, the method includes coupling a reciprocating rod with the hub.

BRIEF DESCRIPTION OF THE DRAWINGS

The detailed description particularly refers to the accompanying figures in which.

DETAILED DESCRIPTION

Figure 1:
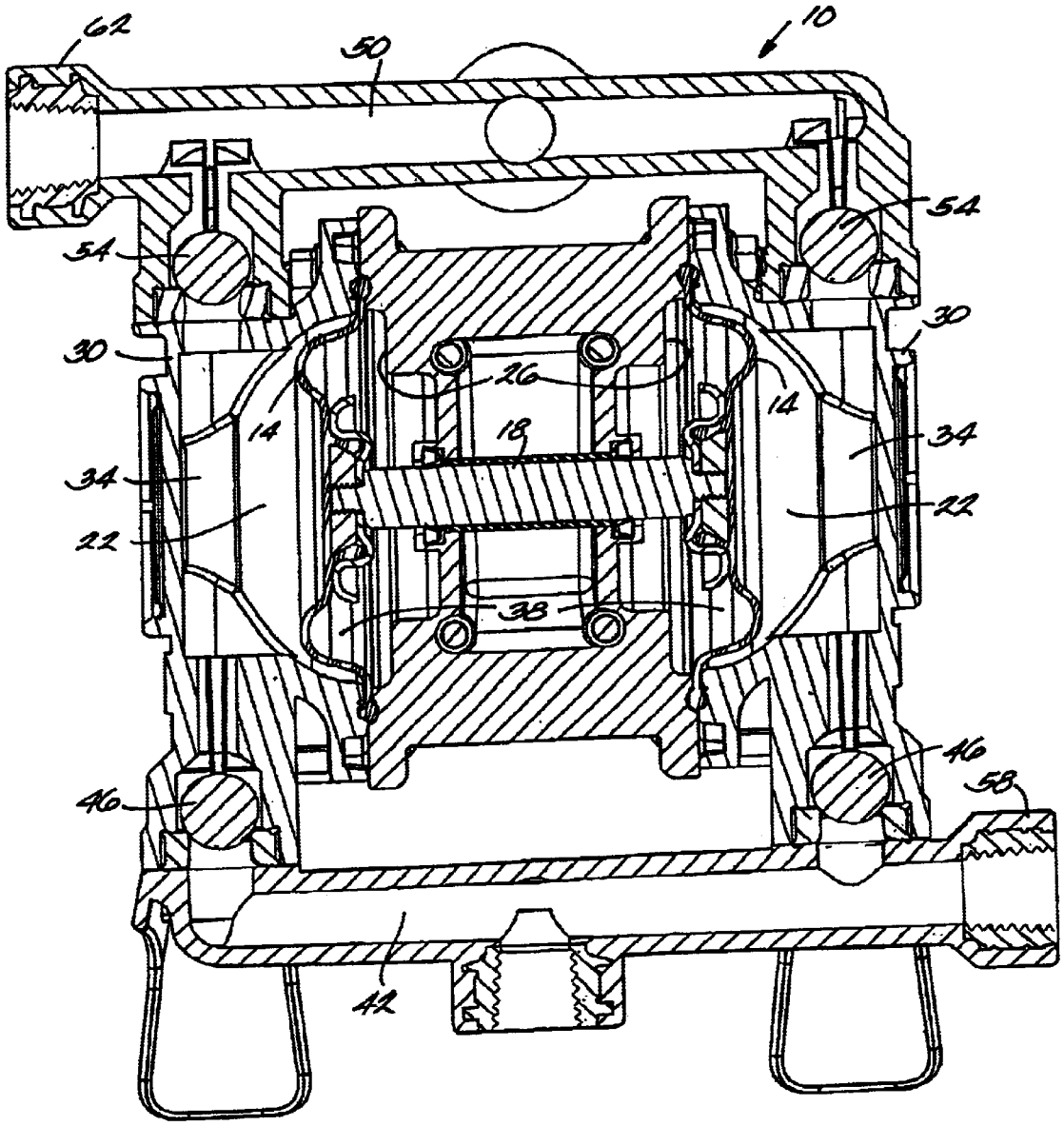
FIG. 1 is a section view of a double diaphragm pump illustrating a first connecting configuration of a diaphragm and a reciprocating connecting rod according to the present invention.

With reference to FIG. 1, a double diaphragm pump 10 is shown including a connecting configuration according to the present invention between a diaphragm 14 and a connecting rod 18. However, as will be readily apparent to those of ordinary skill in the art, the connecting configuration is not limited for use in double diaphragm pumps 10 only. The connecting configuration may also be used, for example, in a single diaphragm pump, as well as other types of diaphragm pumps.

The double diaphragm pump 10 includes two pumping cavities 22 formed between an air cap 26 and a fluid cap 30. Each cavity 22 includes a fluid chamber 34 and an air chamber 38, the chambers 34, 38 being separated by the diaphragm 14 spanning the width of the cavity 22. The diaphragms 14 are interconnected by the connecting rod 18, such that forced movement of one diaphragm 14 imparts opposite movement to the other diaphragm 14. Each fluid chamber 34 is selectively fluidly connected to an inlet manifold 42 via an inlet valve 46, and selectively fluidly connected to an outlet manifold 50 via an outlet valve 54. The inlet manifold 42 includes an inlet 58 which is fluidly connected with a source of fluid or other material to be pumped through the pump 10, while the outlet manifold 50 includes an outlet 62 which routes the pumped fluid or other material away from the pump 10.

An air valve (not shown) imparts reciprocating movement to the connecting rod 18 to cause the diaphragms 14 to pump alternating volumes of fluid through the inlet valves 46 of each respective fluid chamber 34. By introducing pressurized air into one air chamber 38, the diaphragm 14 is caused to move toward the associated fluid chamber 34 to pump the contained fluid through the outlet valve 54 to the outlet manifold 50. At about the same time, the other diaphragm 14 is caused to move away from its (empty) fluid chamber 34, thus creating a vacuum to draw fluid from the inlet manifold 42 through the inlet valve 46. Upon completing the required stroke of the diaphragms 14 and connecting rod 18, pressurized air is introduced into the other air chamber 38 and the pumping process repeats. With the exception of the diaphragms 14, connecting rod 18, and the connecting configurations between the diaphragms 14 and connecting rod 18 (discussed in more detail below), further detailed description of the structure and operation of the double diaphragm pump 10 is not included herein because such structure and operation is considered well known to those skilled in the art.

Figure 2:
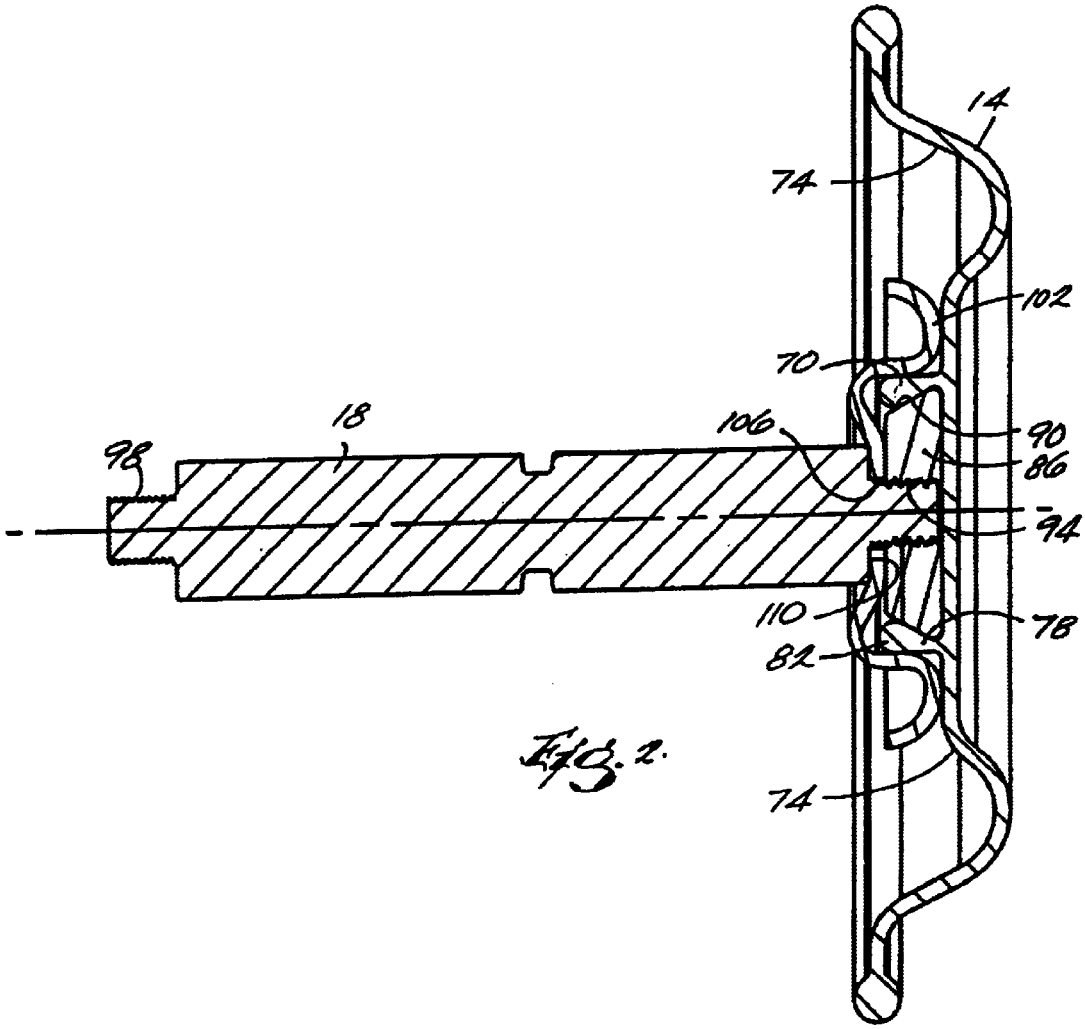
FIG. 2 is an enlarged section view of the diaphragm and connecting rod of FIG. 1, illustrating the connecting configuration between the diaphragm and the connecting rod.

FIGS. 1–2 illustrate a first connection configuration between the diaphragms 14 and the connecting rod 18 according to the present invention. Each of the diaphragms 14 include a bead of varied cross section, or a rim 70, projecting from an inner surface 74 of the diaphragm 14. The rim 70 includes a base portion 78 at the interface of the rim 70 and the inner surface 74 of the diaphragm 14, and a distal portion 82 situated away from the base portion 78. Referring to the section illustrated in FIGS. 1–2, the distal portion 82 is thicker than the base portion 78, thus forming a taper in the rim 70.

Figure 3:
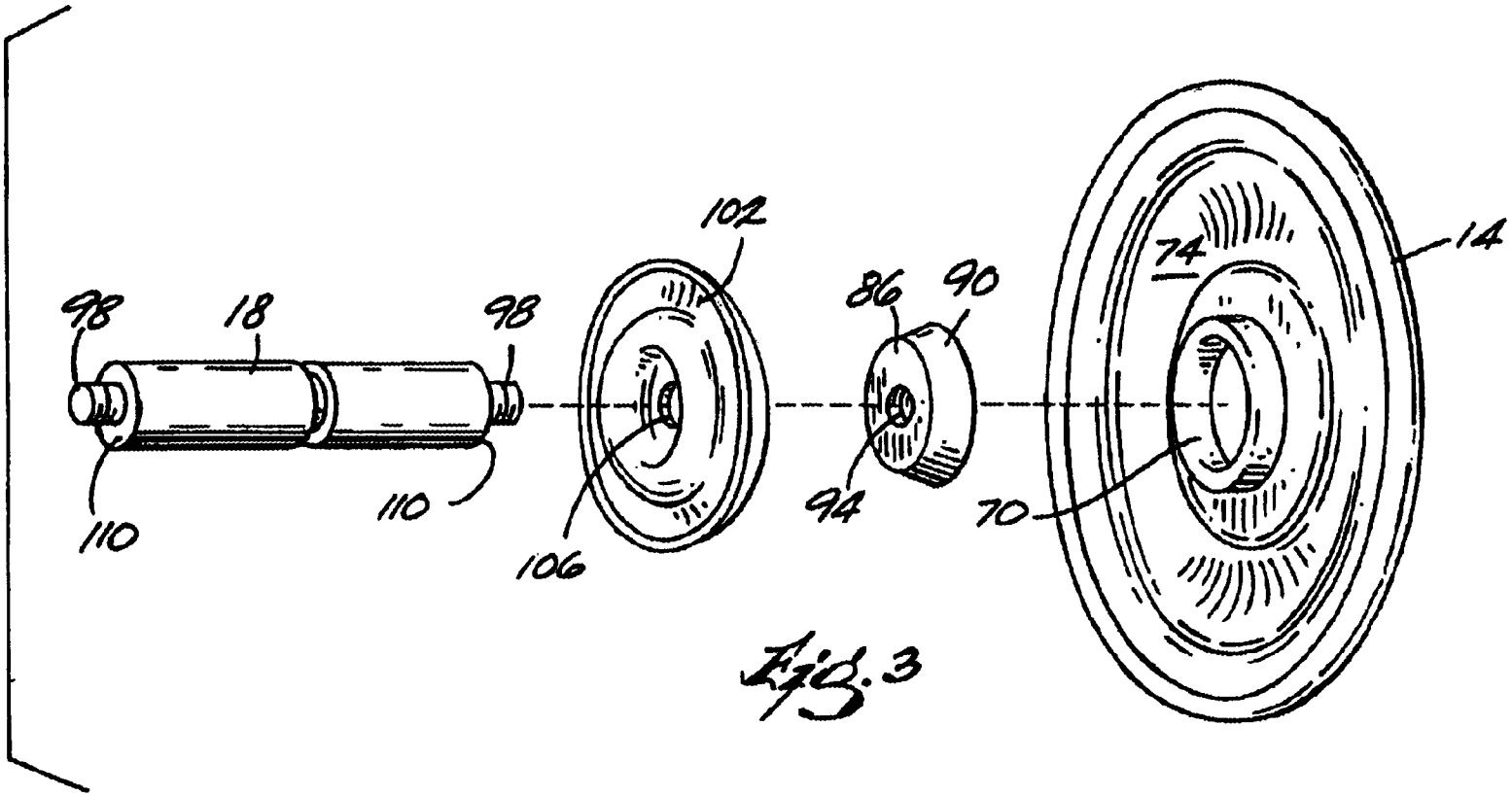
FIG. 3 is an exploded perspective view of the diaphragm and connecting rod of FIG. 2.

As shown in FIGS. 1–3, an encapsulating rim, or a tapered hub 86 interconnects with an inner circumferential surface of the rim 70. The distal portion 82 of the rim 70 is generally adjacent the narrower end of the hub 86, while the base portion 78 of the rim 70 is generally adjacent the wider end of the hub 86. An outer tapered surface 90 of the hub 86 may be knurled, textured, or serrated to substantially resist rotation within the rim 70 and extrusion from the rim 70 when the outer tapered surface 90 of the hub 86 mates with the inner circumferential surface of the rim 70. Also, the hub 86 includes a threaded bore 94 to receive a similarly threaded end 98 of the connecting rod 18. Alternatively, the hub 86 may include a threaded stud (not shown) projecting therefrom to connect with a similarly threaded bore (not shown) in an end of the connecting rod 18.

The rim 70 is formed on the diaphragm 14 to be relatively stiff, such that the rim 70 resists outward deflection upon attempted removal of the hub 86 from the rim 70. The matching tapers of the rim 70 and hub 86 provide a "wedge" that substantially prevents removal of the hub 86 from the rim 70 once they are interconnected. However, due to the frequency of the reciprocal motion and the desired operating life of the pump 10, a retaining ring 102 is utilized on the outer circumferential surface of the rim 70 to more positively secure the diaphragm 14 to the rod 18. The retaining ring 102 provides radial support to the rim 70 to prevent outward deflection of the rim 70, thus reinforcing the "wedge" between the matching tapers of the rim 70 and hub 86. As shown in FIGS. 1–3, the retaining ring 102 includes a centralized aperture 106 allowing passage of the threaded end 98 of the connecting rod 18. The retaining ring 102 is pinched between a shoulder 110 of the connecting rod 18 and the hub 86 to maintain the ring's position engaging the outer circumferential surface of the rim 70. Further, the retaining ring 102 may threadably engage the connecting rod 18 rather than being pinched between the shoulder 110 of the connecting rod 18 and the hub 86. Alternatively, the retaining ring 102 may be in the form of a circular band or clamp that wraps around and constricts the outer circumferential surface of the rim 70 without being pinched between the shoulder 110 of the connecting rod 18 and the hub 86.

With reference to FIG. 3, an exploded perspective view of the diaphragm 14, connecting rod 18, and their connecting components is shown to illustrate their assembly. As shown, the hub 86 is interconnected with the rim 70 to secure the hub 86 to the diaphragm 14. Next, the retaining ring 102 is inserted over the rim 70 to substantially enclose the rim 70 and hub 86. Finally, the threaded end 98 of the connecting rod 18 is threaded into the threaded bore 94 of the hub 86. The knurled outer tapered surface 90 of the hub 86 substantially prevents the hub 86 from rotating within the rim 70 to allow the rod 18 to be tightened securely to the hub 86.

Figure 4:
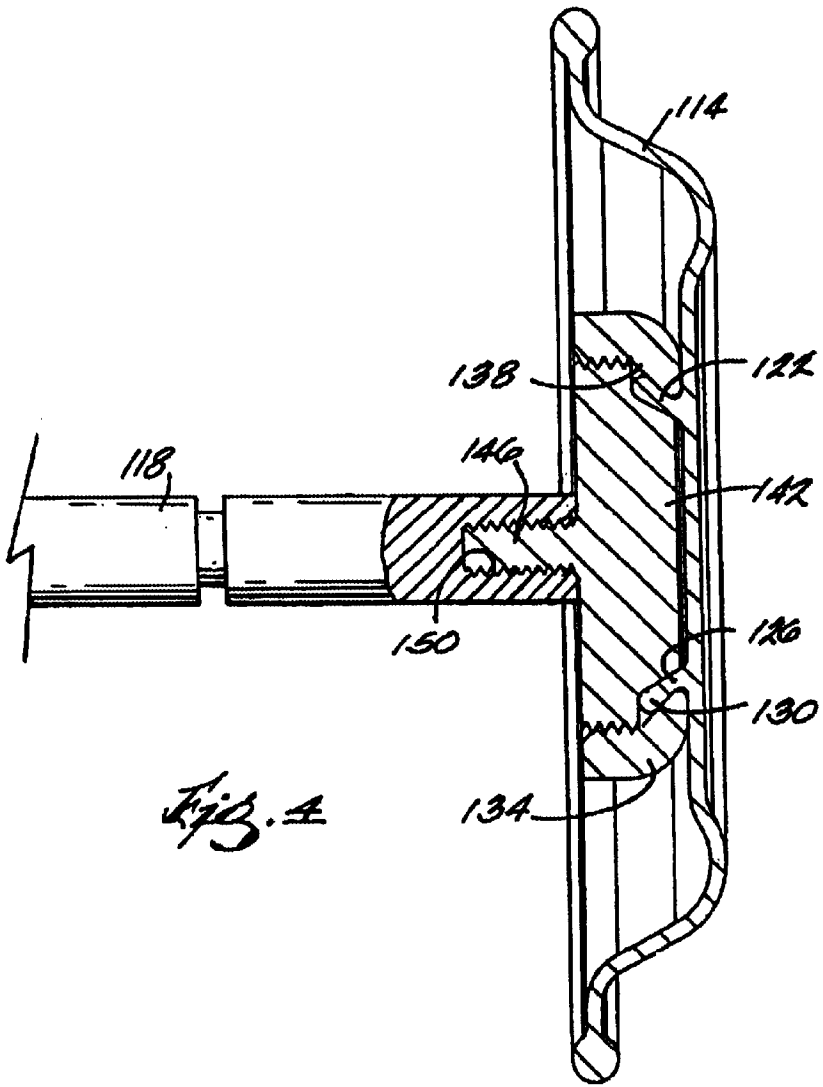
FIG. 4 is an enlarged section view of a diaphragm and connecting rod, illustrating another connecting configuration between the diaphragm and connecting rod.

With reference to FIG. 4, another construction of the connecting configuration between a diaphragm 114 and connecting rod 118 is shown. The diaphragm 114 includes a rim 122 having a slightly different-form than that of the rim 70 illustrated in FIGS. 1–3. The rim 122 similarly includes a base portion 126 at the interface of the rim 122 and the diaphragm 114, and a distal portion 130 situated away from the base portion 126. In the section illustrated in FIG. 4, the distal portion 130 is thicker than the base portion 126, thus forming a taper in the rim 122. A tapered outer hub 134 interconnects with the outer circumferential surface of the rim 122. The distal portion 130 of the rim 122 is generally adjacent the wider end of the outer hub 134, while the base portion 126 of the rim 122 is generally adjacent the narrower end of the outer hub 134. An inner tapered surface 138 of the outer hub 134 is knurled to substantially resist rotation on the rim 122 when the inner tapered surface 138 of the outer hub 134 mates with the outer circumferential surface of the rim 122.

The rim 122 is formed on the diaphragm 114 to be relatively stiff, such that the rim 122 resists inward deflection upon attempted removal of the outer hub 134 from the rim 122. The matching tapers of the rim 122 and outer hub 134 provide a "wedge" that substantially prevents removal of the outer hub 134 from the rim 122 once they are interconnected. However, because of the frequency of the reciprocal motion and the desired operating life of the pump 10, an inner hub 142 is positioned to engage the inner circumferential surface of the rim 122 to more positively secure the diaphragm 114 to the rod 118. The inner hub 142 provides radial support to the rim 122 to prevent inward deflection of the rim 122, thus reinforcing the "wedge" between the matching tapers of the rim 122 and outer hub 134. The inner hub 142 is threadably engaged with the outer hub 134 to maintain the inner hub's position engaging the inner circumferential surface of the rim 122. In addition, the inner hub 142 includes a threaded stud 146 projecting therefrom to engage a similarly threaded bore 150 in the connecting rod 118. Alternatively, the inner hub 142 may include a threaded bore (not shown) to receive a similarly threaded end (not shown) of the connecting rod 118.

Figure 5:
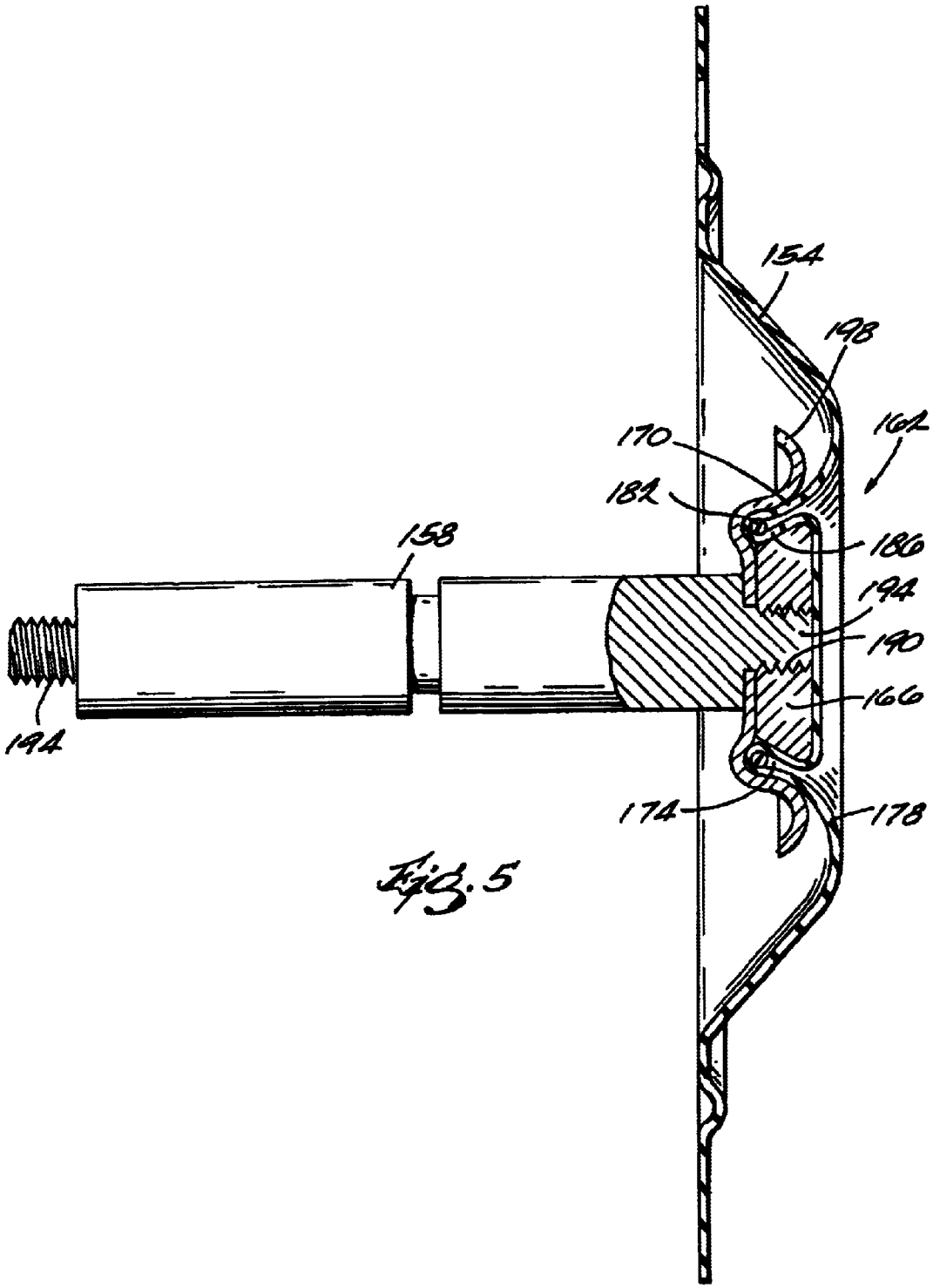
FIG. 5 is an enlarged section view of a diaphragm and connecting rod, illustrating yet another connecting configuration between the diaphragm and connecting rod.

With reference to FIG. 5, yet another connecting configuration between a diaphragm 154 and connecting rod 158 is shown. The diaphragm 154 includes a central portion 162 formed having a tapered inner circumferential surface to receive a tapered hub 166 that is similar in shape to the hub 86 of FIGS. 1–3. The central portion 162 of the diaphragm 154 also includes a projecting rim 170 integrally formed with the central portion 162, such that the projecting rim 170 includes a recess 174 on an outer diaphragm surface 178. Upon insertion of the hub 166 into the central portion 162, which is formed to be relatively stiff, the rim 170 resists outward deflection upon attempted removal of the hub 166 from the rim 170. The matching tapers of the rim 170 and hub 166 provide a "wedge" that substantially prevents removal of the hub 166 from the rim 170 when they are interconnected. However, a band or o-ring 182 is positioned within the recess 174 of the projecting rim 170 to more positively secure the diaphragm 154 to the hub 166. The o-ring 182 provides radial support to the rim 170 to prevent outward deflection of the rim 170, thus reinforcing the "wedge" between the matching tapers of the rim 170 and hub 166.

Like the hub 86 of FIGS. 1–3, an outer tapered surface 186 of the hub 166 may be knurled, textured, or serrated to substantially resist rotation within the rim 170 and extrusion from the rim 170 when the outer tapered surface 186 of the hub 166 mates with the tapered inner circumferential surface of the rim 170. Also, the hub 166 includes a threaded bore 190 to receive a similarly threaded end 194 of the connecting rod 158. Alternatively, the hub 166 may include a threaded stud (not shown) projecting therefrom to connect with a similarly threaded bore (not shown) in an end of the connecting rod 158.

Also, a retaining ring 198, similar to the retaining ring 102 of FIGS. 1–3, is used to provide additional radial support to the rim 170. Further, the ring is coupled between the rod 158 and hub 166 in a similar configuration as previously described and shown in FIGS. 1–3.

In the constructions illustrated in FIGS. 1–4, the diaphragms 14, 114 are made from an elastomer, such as rubber. However, the diaphragms 14, 114 may also be made from a variety of other elastomers such as neoprene, polyurethane, nitrile (buna-n), silcone, vinyl, TPE's and so forth. Also, the diaphragms 14, 114 may be formed having portions of different durometers. For example, the rims 70, 122 may be formed of a higher or lower durometer elastomer, compared to the remaining portions of the diaphragms 14, 114 to affect the rim's clamping characteristics between the hub 86 and retaining ring 102, or the outer hub 134 and the inner hub 142.

In the construction illustrated in FIG. 5, the diaphragm 154 is made from a polymer, such as polytetrafluoroethylene (PTFE), which is more commonly known by the trade name TEFLON®. Diaphragms 154 made from PTFE, for example, generally yield a longer operating life when compared to conventional elastomeric diaphragms. The connecting configuration shown in FIG. 5, for example, is particularly suited for use with a TEFLON® diaphragm 154 and o-ring 182. Alternatively, the construction illustrated in FIG. 5 may also be made from an elastomer, such as the constructions illustrated in FIGS. 1–4.

The hubs 86, 134, 142, 166 and connecting rods 18, 118, 158 are made from metal by a manufacturing process such as powder casting, machining, forging, and so forth. The retaining rings 102, 198 are preferably made from sheet steel by a stamping process. Alternatively, the hubs 86, 134, 166, connecting rods 18, 118, 158 and retaining rings 102, 198 may be made from plastic for use in a pump 10 intended for non-corrosive or food grade applications.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention.

What is claimed is:

1. A method of assembling a diaphragm pump, the method comprising:

providing a diaphragm including a substantially orthogonal rim projecting from the diaphragm, the rim having an inner circumferential surface and an outer circumferential surface;

inserting a hub into the rim to engage the inner circumferential surface;

inserting a ring over the rim to engage the outer circumferential surface;

coupling a reciprocating rod with the hub; and pinching the ring between the hub and a shoulder adjacent an end of the rod.

2. The method of claim 1, wherein coupling the rod with the hub includes threadably engaging the rod and the hub.

3. A diaphragm pump comprising:

at least one diaphragm having an inner diaphragm surface, an outer diaphragm surface, and a projecting rim, the rim projecting from the inner diaphragm surface and having an inner circumferential surface and an outer circumferential surface;

a hub positioned to lie within the inner circumferential surface of the projecting rim;

a ring positioned around the outer circumferential surface of the projecting rim, wherein the hub and ring secure the projecting rim there between; and a reciprocating rod coupled to at least one of the hub and the ring;

wherein the inner circumferential surface forms an acute angle with the inner diaphragm surface.

4. The diaphragm pump of claim 3, wherein the rim includes a base portion coupled to the inner diaphragm surface and a distal portion, the distal portion having a larger thickness than the base portion.

5. The diaphragm pump of claim 3, wherein the outer circumferential surface is substantially orthogonal to the inner diaphragm surface.

6. The diaphragm pump of claim 3, wherein the hub includes a tapered outer circumferential surface, and wherein the tapered outer circumferential surface is in mating contact with a similarly tapered inner circumferential surface of the projecting rim.

7. The diaphragm pump of claim 3, wherein the hub includes a threaded bore, and wherein the rod includes a similarly threaded end to fasten to the threaded bore of the hub.

8. The diaphragm pump of claim 3, wherein the ring provides radial support to the projecting rim.

9. The diaphragm pump of claim 3, wherein the rod includes a shoulder adjacent an end of the rod, and wherein the ring is pinched between the shoulder and the hub.

10. A diaphragm pump comprising:

at least one diaphragm having an inner diaphragm surface, an outer diaphragm surface, and a projecting rim, the rim projecting from the inner diaphragm surface and having an inner circumferential surface and an outer circumferential surface;

a hub positioned to lie within the inner circumferential surface of the projecting rim;

a ring positioned around the outer circumferential surface of the projecting rim, wherein the hub and ring secure the projecting rim there between; and a reciprocating rod coupled to at least one of the hub and the ring;

wherein the rim includes a base portion coupled to the inner diaphragm surface and a distal portion, the distal portion having a larger thickness than the base portion;

wherein the rim includes a proximal portion between the base portion and distal portion, the proximal portion having a larger thickness than the base portion and a smaller thickness than the distal portion.

11. The diaphragm pump of claim 10, wherein the inner and outer circumferential surfaces of the rim form an obtuse angle with the inner diaphragm surface.

12. The diaphragm pump of claim 10, wherein the outer circumferential surface is substantially orthogonal to the inner diaphragm surface.

13. The diaphragm pump of claim 10, wherein the hub includes a tapered outer circumferential surface, and wherein the tapered outer circumferential surface is in mating contact with a similarly tapered inner circumferential surface of the projecting rim.

14. The diaphragm pump of claim 10, wherein the hub includes a threaded bore, and wherein the rod includes a similarly threaded end to fasten to the threaded bore of the hub.

15. The diaphragm pump of claim 10, wherein the ring provides radial support to the projecting rim.

16. The diaphragm pump of claim 10, wherein the inner circumferential surface forms an acute angle with the inner diaphragm surface.

17. A diaphragm pump comprising:

at least one diaphragm having an inner diaphragm surface, an outer diaphragm surface, and a projecting rim, the rim projecting from the inner diaphragm surface and having an inner circumferential surface and an outer circumferential surface;

a hub positioned to lie within the inner circumferential surface of the projecting rim;

a ring positioned around the outer circumferential surface of the projecting rim, wherein the hub and ring secure the projecting rim there between; and a reciprocating rod coupled to at least one of the hub and the ring;

wherein the rod includes a shoulder adjacent an end of the rod, and wherein the ring is pinched between the shoulder and the hub.

18. The diaphragm pump of claim 17, wherein the outer circumferential surface is substantially orthogonal to the inner diaphragm surface.

19. The diaphragm pump of claim 17, wherein the rim includes a base portion coupled to the inner diaphragm surface and a distal portion, the distal portion having a larger thickness than the base portion.

20. The diaphragm pump of claim 17, wherein the hub includes a tapered outer circumferential surface, and wherein the tapered outer circumferential surface is in mating contact with a similarly tapered inner circumferential surface of the projecting rim.

21. The diaphragm pump of claim 17, wherein the hub includes a threaded bore, and wherein the end of the rod is similarly threaded and is securable in the threaded bore of the hub.

22. The diaphragm pump of claim 17, wherein the ring provides radial support to the projecting rim.

23. The diaphragm pump of claim 17, wherein the inner and outer circumferential surfaces of the rim form an obtuse angle with the inner diaphragm surface.

24. The diaphragm pump of claim 17, wherein the inner circumferential surface forms an acute angle with the inner diaphragm surface.

25. A diaphragm pump comprising:

a diaphragm having a tapered projecting rim projecting from an inner surface of the diaphragm;

a tapered hub having a circumferential outer surface mating with the tapered projecting rim;

a reciprocating rod coupled to the hub; and a ring coupled to the rod and positioned around the projecting rim;

wherein the rod includes a shoulder adjacent an end of the rod, and wherein the ring is pinched between the shoulder and the hub.

26. The diaphragm pump of claim 25, wherein the rim includes an outer circumferential surface, and wherein the outer circumferential surface is substantially orthogonal to the inner surface of the diaphragm.

27. The diaphragm pump of claim 25, wherein the rim includes a base portion coupled to the inner surface of the diaphragm and a distal portion, the distal portion having a larger thickness than the base portion.

28. The diaphragm pump of claim 25, wherein the hub includes a threaded bore, and wherein the end of the rod is similarly threaded and is securable in the threaded bore of the hub.

29. The diaphragm pump of claim 25, wherein the ring provides radial support to the projecting rim.

30. The diaphragm pump of claim 25, wherein the rim includes an inner circumferential surface and an outer circumferential surface, and wherein the inner and outer circumferential surfaces of the rim form an obtuse angle with the inner surface of the diaphragm.

31. The diaphragm pump of claim 25, wherein the rim includes an inner circumferential surface, and wherein the inner circumferential surface forms an acute angle with the inner diaphragm surface.

32. A diaphragm pump comprising:

a diaphragm having a projecting rim, the rim defining a base portion coupled to the diaphragm and a distal portion, the distal portion having a larger thickness than the base portion;

a hub having a first end and a second end, the hub tapering from the first end to the second end, the first end being adjacent to the base portion of the rim and the second end being adjacent to the distal portion of the rim;

a ring engaging an outer circumferential surface of the rim, such that the projecting rim is pinched between the hub and the ring; and a reciprocating rod coupled to the hub, wherein the ring is secured to the hub between the rod and the hub.

33. The diaphragm pump of claim 32, wherein the diaphragm includes an inner diaphragm surface, and wherein the base portion is coupled to the inner diaphragm surface.

34. The diaphragm pump of claim 33, wherein the rim includes an outer circumferential surface, and wherein the outer circumferential surface is substantially orthogonal to the inner diaphragm surface.

35. The diaphragm pump of claim 32, wherein the hub includes a threaded bore, and wherein the rod includes a similarly threaded end to fasten to the threaded bore of the hub.

36. The diaphragm pump of claim 35, wherein the rod includes a shoulder adjacent the threaded end.

37. The diaphragm pump of claim 36, wherein the ring is pinched between the shoulder and the hub.

38. The diaphragm pump of claim 32, wherein the ring provides radial support to the rim.

* * * * *